US009920763B2

(12) United States Patent
Borkowski

(10) Patent No.: US 9,920,763 B2
(45) Date of Patent: Mar. 20, 2018

(54) CONTACT COOLED ROTARY AIREND INJECTION SPRAY INSERT

(71) Applicant: INGERSOLL-RAND COMPANY, Davidson, NC (US)

(72) Inventor: Michael R. Borkowski, Concord, NC (US)

(73) Assignee: Ingersoll-Rand Company, Davidson, NC (US)

( * ) Notice: Subject to any disclaimer, the term of this patent is extended or adjusted under 35 U.S.C. 154(b) by 127 days.

(21) Appl. No.: 14/857,479

(22) Filed: Sep. 17, 2015

(65) Prior Publication Data

US 2017/0082107 A1 Mar. 23, 2017

(51) Int. Cl.
*F04C 29/00* (2006.01)
*F04C 18/10* (2006.01)
*F04C 18/107* (2006.01)

(52) U.S. Cl.
CPC ..... *F04C 29/0007* (2013.01); *F04C 18/107* (2013.01)

(58) Field of Classification Search
CPC .... F04C 18/107; F04C 18/16; F04C 29/0007; F04C 2240/80; F04C 29/0014; F04C 28/12
USPC ..... 418/201.1, 194, 87, 201.2
See application file for complete search history.

(56) References Cited

U.S. PATENT DOCUMENTS 3,151,806 A 10/1964 Whitfield
3,314,597 A 4/1967 Schibbye
3,756,753 A 9/1973 Persson et al.
3,820,923 A 6/1974 Zweifel
4,042,310 A 8/1977 Schibbye et al.
4,453,900 A 6/1984 Schibbye et al.
4,498,849 A 2/1985 Schibbye et al.
5,201,648 A 4/1993 Lakowske
5,653,585 A 8/1997 Fresco
RE36,281 E 8/1999 Zuercher et al.
6,257,837 B1 7/2001 Adams et al.
7,201,569 B2 * 4/2007 Hossner ..... F04C 18/16 418/201.1
7,690,482 B2 4/2010 Shoulders
8,794,941 B2 8/2014 Santos et al.
2004/0040332 A1 * 3/2004 Roelke ..... F04C 18/16 62/296

(Continued)

FOREIGN PATENT DOCUMENTS

CN 102425549 B 12/2014

OTHER PUBLICATIONS http://www.docstoc.com/docs/89242934/LubriMist-Oil-Mist-Accessories-Brochure-(PDF).

*Primary Examiner* — Mark Laurenzi
*Assistant Examiner* — Dapinder Singh
(74) *Attorney, Agent, or Firm* — Sunstone IP

(57) ABSTRACT

A compressor having a compressor wall that has an interior surface that defines a compression chamber, in which a rotor or pair of rotors operates to compress a fluid. To do so, the rotors are in operative communication with the interior surface. The compressor also includes an injection port in the compressor wall and opening into the compression chamber, the injection port being in fluidic communication with a second fluid. The compressor can also include an insert in operative communication with the injection port, wherein the insert and the injection port define therebetween a gap through which the second fluid enters the compression chamber.

11 Claims, 4 Drawing Sheets

(56) References Cited

U.S. PATENT DOCUMENTS

| | | | | |
|---|---|---|---|---|
| 2005/0226758 | A1* | 10/2005 | Hossner ..... | F04C 18/16<br>418/201.1 |
| 2011/0256008 | A1 | 10/2011 | Hattori et al. | |
| 2014/0127067 | A1 | 5/2014 | Kienzle | |

* cited by examiner

CONTACT COOLED ROTARY AIREND INJECTION SPRAY INSERT

BACKGROUND

Technical Field

The present disclosure relates to compressors, and, in particular, to a mechanism for managing the flow of lubricant/coolant in a compressor.

State of the Art

A compressor system including, for example a contact-cooled rotary screw airend, may introduce a lubricating coolant, such as oil, into the compression chamber. The amount and temperature of the lubricating coolant may have an effect on the overall performance of the airend.

There is thus a need to develop measures to control and manage the flow of a lubricating coolant of the compressor system.

SUMMARY

The present disclosure relates to compressors, and, in particular, to an insert to be inserted in the flow path of lubricant/coolant in a compressor for managing the flow and temperature thereof.

An aspect of the present disclosure includes a compressor comprising: a compressor wall having an interior surface defining a compression chamber; a rotor positioned within the compression chamber and in operative communication with the interior surface; an injection port in the compressor wall and opening into the compression chamber, the injection port being in fluidic communication with a fluid; an insert in operative communication with the injection port, wherein the insert and the injection port define therebetween a gap through which the fluid enters the compression chamber.

Another aspect of the present disclosure includes wherein the insert is positioned within the injection port, the injection port being a cylindrical bore having a first diameter and the insert being a cylindrical member having a second diameter about half the size of the first diameter.

Another aspect of the present disclosure includes wherein the gap is an annular gap and the fluid entering the compression chamber has a conical or ring-like shape.

Another aspect of the present disclosure includes an injection port insert comprising: a head portion; and an elongate body coupled to the head portion and extending therefrom; a flared region of the elongate body proximate a distal end of the elongate body; wherein the head portion releasably couples to an injection port positioned in a sidewall of a compressor, the injection port opening to a compression chamber of the compressor, wherein the elongate body extends through the injection port and the distal end is exposed to the compression chamber, wherein the flared region influences a fluid entering the compression chamber.

Another aspect of the present disclosure includes a method of injecting fluid into a compressor, the method comprising: introducing a fluid flow into an injection port that opens to a compression chamber of a compressor; increasing a velocity of the fluid flow as the fluid flow enters the compression chamber at the injection port; and shaping the fluid flow entering the compression chamber at the injection port.

The foregoing and other features, advantages, and construction of the present disclosure will be more readily apparent and fully appreciated from the following more detailed description of the particular embodiments, taken in conjunction with the accompanying drawings.

BRIEF DESCRIPTION OF THE DRAWINGS

Some of the embodiments will be described in detail, with reference to the following figures, wherein like designations denote like members.

DETAILED DESCRIPTION OF EMBODIMENTS

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

The drawings depict illustrative embodiments of a fluid compression system 10. These embodiments may each comprise various structural and functional components that complement one another to provide the unique functionality and performance of the system 10, the particular structure and function of which will be described in greater detail herein.

Figure 1:
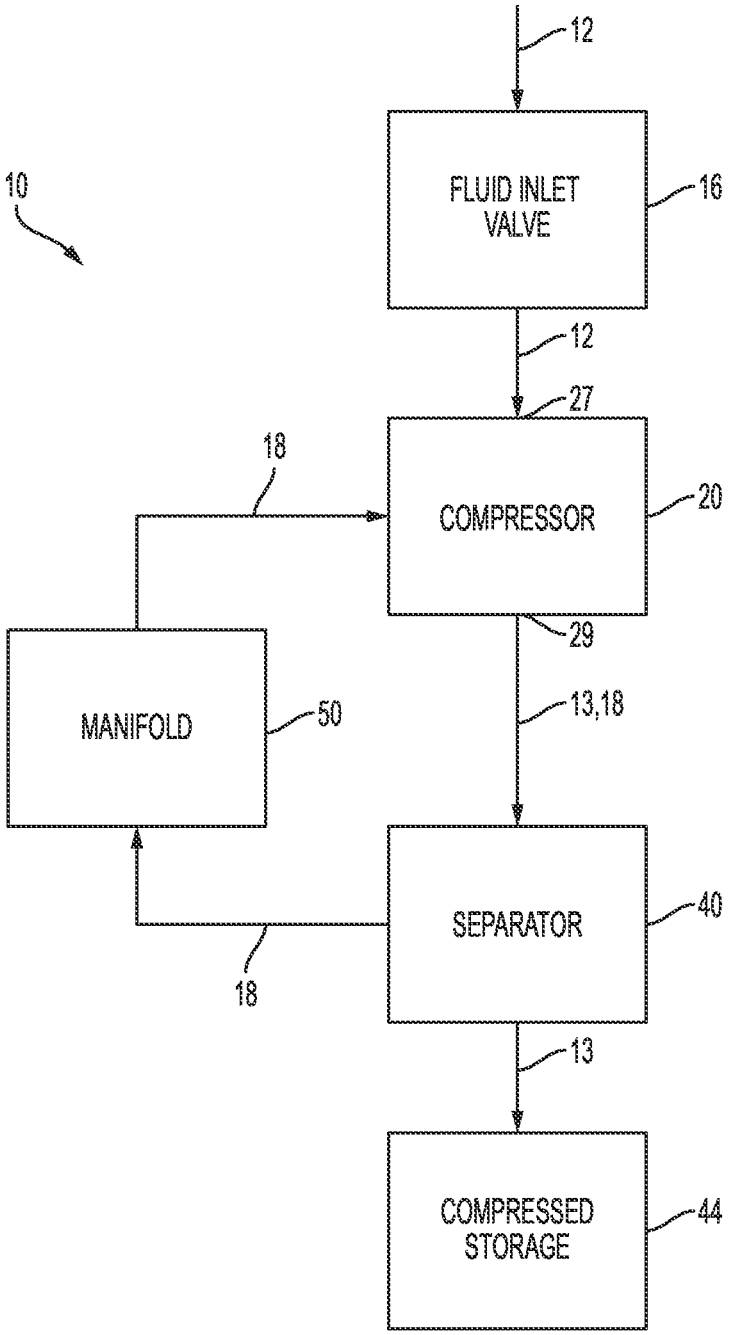
FIG. 1 is a schematic view of an illustrative embodiment of a fluid compression system in accordance with the present disclosure.
Figure 2:
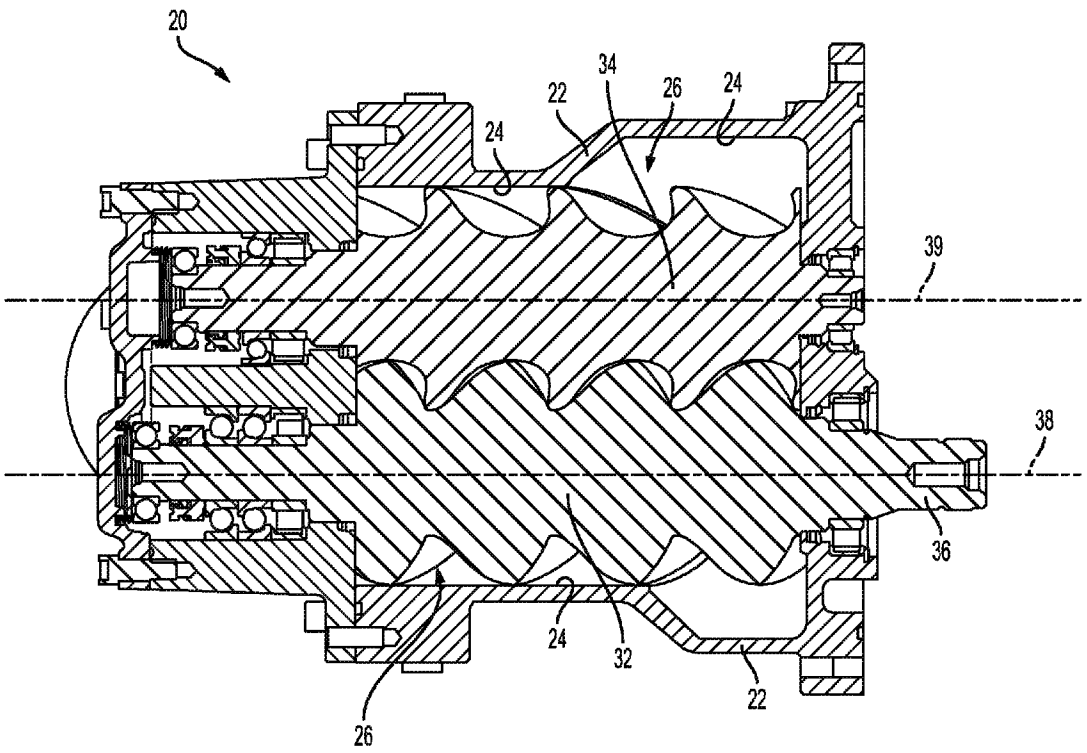
FIG. 2 is a cross-sectional view of an illustrative embodiment of a compressor component of a fluid compression system in accordance with the present disclosure.

Referring to the drawings, FIGS. 1 and 2 depict an illustrative embodiment of a fluid compression system 10. Embodiments of the system 10 may comprise a compressor 20 having a wall 22 that has an interior surface 24 defining an interior volume or space that constitutes a compression chamber 26. The compressor 20 may receive a first fluid 12 from a fluid source (not depicted) through a fluid inlet valve 16. The volume of the first fluid 12 that is introduced into the compressor 20 may be controlled by the fluid inlet valve 16. The first fluid 12 may be air, coolant, or other compressible fluid or gas. The first fluid 12 may enter the compressor 20 via the fluid inlet valve 16 at ambient pressure and/or temperature. Once passing through the fluid inlet valve 16, the first fluid 12 may enter the compression chamber 26 through an inlet 27 in the wall 22. Once inside the compression chamber 26, the first fluid 12 may be compressed by operation of compressor components, to be discussed further herein. Once compressed, the first fluid 12 may exit the compression chamber 26 through an exit 29 in the wall 22. The inlet 27 and the exit 29 may be configured on opposing ends of the compressor 20.

With further reference to FIG. 2, the compressor 20 may further comprise a pair of rotors, a first rotor 32 and a second rotor 34 positioned within the compression chamber 26. The first and second rotors 32 and 34 may be configured to functionally and operatively engage one another during operation of the compressor 20 to compress the first fluid 12 thereby. The first and second rotors 32 and 34 may include helical splines running about their respective circumferences, the helical splines of each rotor 32 and 34 being configured to engage a corresponding groove between neighboring splines on the other rotor 32 and 34. In other words, the first and second rotors 32 and 34 may be intermeshed screw rotors that may be paired with one another so that a male rotor is paired with a female rotor. For example, the first rotor 32 may be driven by a motor (not depicted) operatively coupled to a shaft 36 that is part of the first rotor 32, the shaft 36 extending out of the wall 22 of the compressor 20. The motor (not depicted) may be configured to engage and drive the shaft 36 in a rotational motion to rotate the first rotor 32 about an axis 38. With the first rotor 32 in meshed communication with the second rotor 34, as described herein, the rotation of the first rotor 32 drives the rotation of the second rotor 34 about an axis 39. As such, the rotors 32 and 34 rotate together and thereby compress the first fluid 12 there between as the first fluid 12 is introduced into the compression chamber 26.

Figure 3:
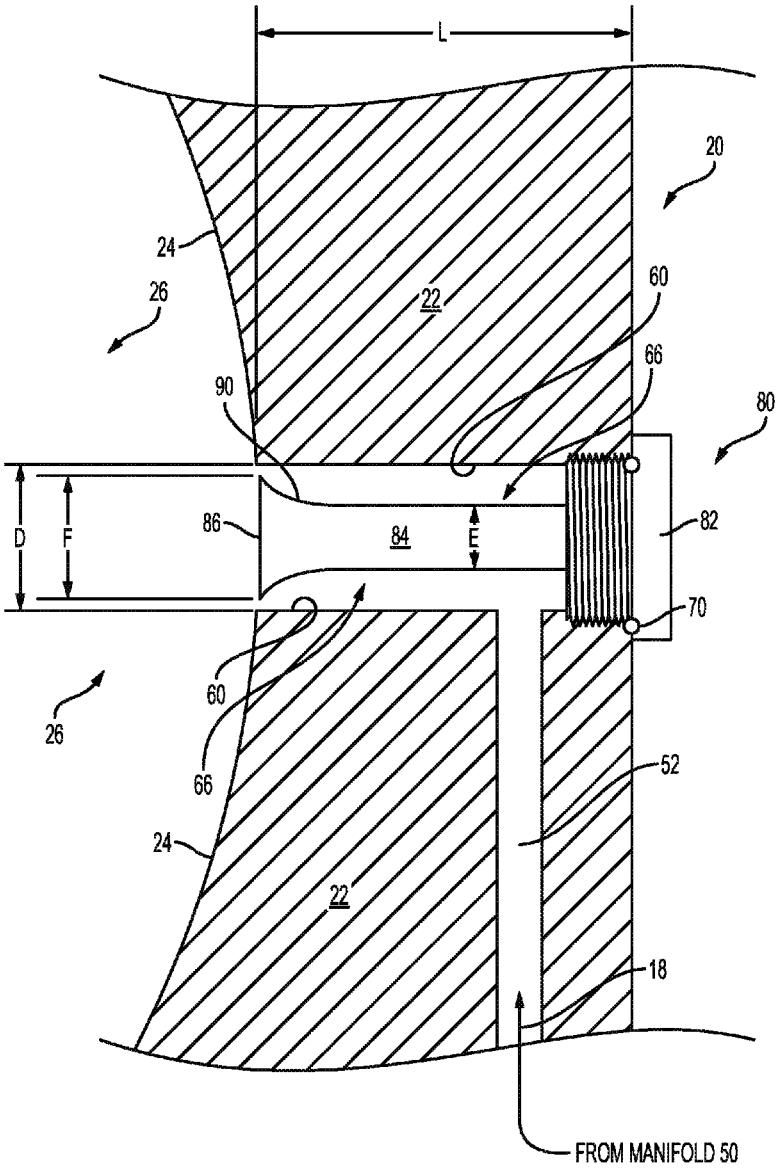
FIG. 3 is a partial, cross-sectional view of an illustrative embodiment of a compressor insert within a compressor component of a fluid compression system in accordance with the present disclosure.

With reference to FIG. 3, embodiments of the system 10 may further comprise the compressor 20 including an injection port 60. The injection port 60 may be positioned in the wall 22 of the compressor 20 and open to the compression chamber 26. The injection port 60 may be constructed in the shape of a cylinder, such that the injection port 60 has a defined diameter D. The injection port 60 may further have an axial length L that substantially corresponds to the thickness of the wall 22. The injection port 60 may also be arranged in fluidic communication with a manifold 50 that handles, directs, and otherwise manages the flow of a second fluid 18 into the compression chamber 26. Accordingly, the injection port 60 may be the means by which the second fluid 18 is introduced into the compression chamber 26 from the manifold 50. As such, the second fluid 18 may cooperate with the first fluid 12 and the compression components to compress the first fluid 12 within the compression chamber 26 until the first fluid 12 reaches a desired level of compression to become a compressed first fluid 13. Once adequately compressed, the compressed first fluid 13 and the second fluid 18 may exit the compression chamber 26 together by way of the exit 29. The mixed compressed first fluid 13 and the second fluid 18 may thereafter enter a separator 40 that is in flow communication with the compressor 20. Within the separator 40, the compressed first fluid 13 and the second fluid 18 may be separated from one another, with the compressed first fluid 13 being sent to and stored within a compressed fluid storage 44 and the second fluid 18 being transported through the manifold 50, which may be in fluid communication with the compressor 20. Accordingly, the compressed first fluid 13 may be stored within the compressed fluid storage 44 and be readily available to an end user or a point of use, whereas the second fluid 18 may be managed by the manifold 50 to be reused by the compressor 20 in the ongoing compression process of the first fluid 12 into the compressed first fluid 13.

The second fluid 18 may be a liquid having the characteristics and properties that allow the second fluid 18 to perform many useful functions within the compression chamber 26. For example, the second fluid 18 may be an oil or an oil-based liquid. As such, the second fluid 18 may function as a liquid sealant against the interior surface 24 of the wall 22 and the intermeshed rotors 32 and 34 as the intermeshed rotors 32 and 34 come into contact with the interior surface 24 during rotation of the intermeshed rotors 32 and 34 within the compression chamber 26. The second fluid 18 may also act as a liquid sealant between the corresponding splines and grooves of the intermeshed rotors 32 and 34 as the rotors 32 and 34 make contact with one another during rotation. Creating and maintaining an adequate seal between component parts 24, 32 and 34 of the compressor 20 during rotation increases the efficiency of the compressor 20 because the fluidic seal can restrict or even prevent the first fluid 12 from escaping between the component parts 24, 32 and 34.

The second fluid 18 may also act, for example, as a lubricant between the component parts of the compressor 20 within the compression chamber 26. For example, the second fluid 18 may come into contact with the interior surface 24 of the wall 22 as well as the rotors 32 and 34. As such, the second fluid 18 may function as a lubricant between corresponding splines and grooves of the intermeshed rotors 32 and 34, as the rotors 32 and 34 make contact with one another during rotation, as well as between the rotors 32 and 34 and the interior surface 24. The second fluid 18 may therefore function to prevent excessive wear between the rotors 32 and 34 themselves as well as between the interior surface 24 and the rotors 32 and 34, which may serve to extend the longevity of the compressor 20.

The second fluid 18 may also be used, for example, to cool the first fluid 12 undergoing compression within the compression chamber 26. The second fluid 18 may be introduced into the compression chamber 26 at a reduced temperature and absorb some of the heat generated by the compression of the first fluid 12. The heated second fluid 18 may then exit the compression chamber 26 along with the heated compressed first fluid 13, as discussed above, and enter the separator 40 to therein be separated from one another. The heated second fluid 18 may thereafter be cooled in the manifold 50 in preparation to re-enter the compression chamber 26 at the reduced temperature. This cooling methodology reduces thermal expansion of the rotors 32 and 34 that might otherwise occur as a result of the heat generated during the compression process. In addition, utilizing the second fluid as a coolant can permit even tighter clearances between the rotors 32 and 34 and the interior surface 24 defining the compression chamber 26.

With further reference to FIG. 3, embodiments of the system 10 may further comprise a line 52 in fluidic communication with the manifold 50, the line 52 being configured to direct at least a portion of the second fluid 18 in the manifold 50 toward and/or into the injection port 60. Thus, the line 52 may intersect with the injection port 60 to thereby place the injection port 60 in fluidic communication with the second fluid 18 and the manifold 50. With the second fluid 18 in fluidic communication with the injection port 60 and the injection port 60 opening to the compression chamber 26, the manifold 50 is able to deliver, introduce, and otherwise supply the second fluid 18 to the compression chamber 26 and the component parts of the compressor 20 housed therein, such as the rotors 32 and 34 and the interior surface 24. In this way, the second fluid 18 is able to provide the advantageous effects described herein.

Embodiments of the system 10 may further comprise more than one injection port 60 being configured in the wall 22 of the compressor 20 and more than one corresponding lines 52 that fluidically connect each of the injection ports 60 to the manifold 50 and the second fluid 18. Furthermore, the lines 52 may be configured to run within the wall 22, such that the lines 52 may in fact function as channels or corridors in which the second fluid 18 may flow. Alternatively, the lines 52 may be exterior to the wall 22, such as in piping, tubing or the like.

Embodiments of the system 10 may further comprise an injection port insert 80 being situated in operative communication with the injection port 60. Embodiments of the injection port insert 80 may comprise a head portion 82 and a body portion 84. The body portion 84 may have an exterior surface 88 and be configured to extend from the head portion 82 to a distal end 86 of the body portion 84, the length of the body portion 84 being defined by the distance between the head portion 82 and the distal end 86. The body portion 84 may be a cylindrically shaped member having an exterior diameter E that is smaller than the diameter D of the injection port 60. The insert 80, and in particular, the body portion 84, may be configured to be inserted within the injection port 60 to influence the flow of the second fluid 18 within and through the injection port 60 and/or out of the injection port 60 and into the compression chamber 26. The body portion 84 may function to reduce the available diameter D of the injection portion 60 to the flow of the second fluid 18 to thereby restrict the flow of the second fluid 18 through the injection port 60. Such restriction may improve the balance, pressure, and flow of the second fluid 18 through the manifold 50 and out of the injection port 60. And, having better balance, pressure, and flow through the manifold 50 may provide more consistent and even distribution of the second fluid 18 to a plurality of injection ports 60. In other words, the insert 80 may function to assist the manifold 50 in providing adequate and consistent fluid pressure of the second fluid 18 to and through each of the injection ports 60.

The head portion 82 of the insert 80 may be configured to releasably couple to the injection port 60 proximate the exterior surfaces of the wall 22 or to the exterior surfaces of the wall 22 proximate the injection port 60, such that the head portion 82 may function to hold the insert 80 in place with respect to the injection port 60 and the wall 22. A sealing member 70 may be positioned between the insert 80 and surfaces of the compressor 20 against which the insert 80 is pressed when the insert 80 is coupled to the compressor 20 as described herein, either to the injection port 60 proximate the exterior of the wall 22 or to the exterior of the wall 22 proximate the injection port 60. The sealing member 70 may function to hermetically seal the injection port 60 from the ingress of debris, contaminant, moisture, or other impurities into the injection port 60 that might otherwise negatively impact the efficient operation of the compressor 20. The insert 80 may be configured to couple to the cross-drills of the injection port 60. The insert 80 may be threadably coupled to the injection port 60 proximate the exterior surfaces of the wall 22 or to the exterior surfaces of the wall 22 proximate the injection port 60.

With the head portion 82 anchored with respect to the compressor 20, the insert 80 may be configured to have the body portion 84 extend along or within at least a portion of the axial length L of the injection port 60, as mentioned above. With the exterior diameter E being smaller than the diameter D of the injection port 60, the diameters D and E may define therebetween an annular gap 66 that may extend along the axial length L of the injection port 60 for as long as of the body portion 84 is long, up to the length L of the injection port 60. Indeed, the annular gap 66 may extend along the entire axial length L of the injection port 60, again, provided that the body portion 84 is sufficiently long. Under such a scenario, the distal end 86 of the body portion 84 may be configured to terminate at the point at which the injection port 60 opens to the compression chamber 26. And with the distal end 86 terminating at the end of the injection port 60, the distal end 86 may be configured to be exposed to the compression chamber 26, and, in some embodiments, may even be flush with the interior surface 24 of the wall 22 of the compressor 20. The distal end 86 may even be configured to have the same contour, shape, or curvature of the interior surface 24 at the point where the injection port 60 opens into the compression chamber 26. Because the curvature of the distal end 86 can match or correspond with the interior surface 24, the rotors 32 and 34 are not disturbed thereby. The distal end 86 may have a concave-type shape, a slanted shape or angled orientation, or a combination of both, based on the position of the injection port 60 in the wall 22 and the curvature of the interior surface 24 at the injection port 60, as exemplarily depicted in FIG. 4B. As such, the distal end 86 may serve its intended purpose, as described herein, without interfering with the operations of the internal compressor components, namely the interaction of the rotors 32 and 34 with the interior surface 24.

With the insert 80 positioned within the injection port 60, the insert 80 may be poised to influence the flow characteristics of the second fluid 18. For example, the shape of the second fluid 18 may be altered. The second fluid 18 may be forced to flow through the injection port 60 and into the compression chamber 26 by way of the annular gap 66 defined between diameters D and E. The annular gap 66 may function therefore as an annular channel or conduit to direct the flow of the second fluid 18 through the injection port 60 and into the compression chamber 26. In this way, as the second fluid 18 exits the injection port 60 and enters the compression chamber 26, it may do so in the shape of a hollow circle, ring, or annular shape that is shaped or influenced by the substantially concentric diameters D and E. Moreover, because the distal end 86 may be or have a sloped portion, the second fluid 18 may exit the injection port 60 and enter the compression chamber 26 in a conical shape or pattern. The second fluid 18 can therefore enter the compression chamber 26 in a spray-like pattern that may more evenly distribute the second fluid 18 over the component parts of the compressor 20, such as the interior surface 24 and the rotors 32 and 34.

Also, with the insert 80 positioned within the injection port 60, the velocity of the second fluid 18 through the injection port 60 may be altered. For example, the second fluid 18 may be configured to flow through the injection port 60 at an injection pressure produced in the manifold 50. However, because the diameter D of the injection port 60 is reduced by the diameter E of the insert 80, the radial thickness of the gap 66 (i.e., the distance between the diameter E and the diameter D) is the effective area in which the second fluid 18 may flow through the injection port 60 and into the compression chamber 26. This reduced area may cause the velocity of the second fluid 18 through the injection port 60 to increase, according to the laws of conservation of mass pertaining to fluid flow through tubing or pipe. Moreover, as the velocity of the second fluid 18 increases, the pressure of the flowing fluid is reduced.

In addition thereto, the velocity of the second fluid 18 flowing through the injection port 60 may further be increased by way of a surface feature 90 on the body portion 84 proximate the distal end 86 of the body portion 84. The surface feature 90 may be configured to further reduce the effective area of fluid flow through the injection port 60 at or near the point where the injection port 60 opens into the compression chamber 26. For example, the surface feature 90 may have a sloped surface or region 92 that increases in diameter toward the distal end 86. In this way, the surface feature 90 may therefore provide the body portion 84 with a second diameter F that is larger than the first diameter E, as exemplarily depicted in FIGS. 4A-4C. The second diameter F may thus further reduce the effective area through which the second fluid 18 may flow through the injection port 60 under the injection pressure produced in the manifold 50. This further reduced effective area of fluid flow through the injection port 60 may cause the velocity of the second fluid 18 to increase over the surface feature 90. Consequently, the second fluid 18 may also experience a high pressure drop as the second fluid 18 flows over the surface feature 90 and out into the compression chamber 26. The high pressure drop and the increased velocity of the second fluid 18 may cause atomization effects in the flow of the second fluid 18 as it exits the injection port 60 and sprays into the combustion chamber 26. The spray pattern of the second fluid 18 as the second fluid 18 enters the combustion chamber 26 may improve the aeration of the second fluid 18 and more readily mix with the first fluid 12 flowing through and being compressed within the compression chamber 26. Under these atomization effects, the second fluid 18 may be broken down, separated, or reduced into tiny particles or a fine spray that more evenly disperses onto component parts within the compression chamber 26 to quickly and more efficiently provide the advantageous benefits of the second fluid 18 described herein. Indeed, the improved distribution of the second fluid 18 into the compression chamber 26 may provide additional cooling and sealing benefits to further reduce the power consumption of the system 10 by reducing the blower speed (not pictured).

Figure 4A:
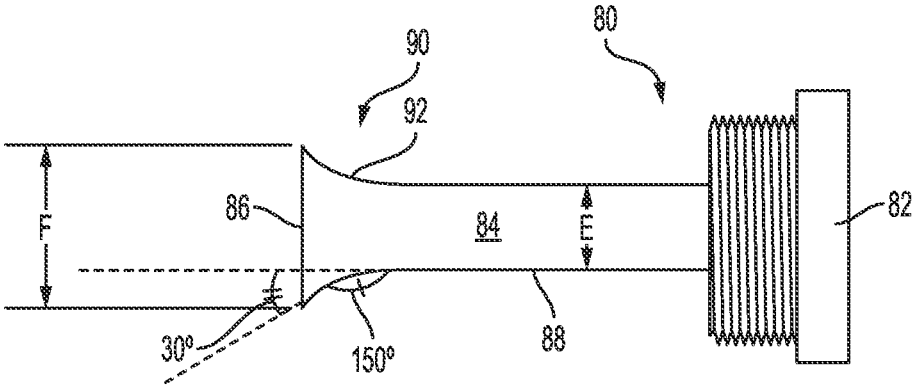
FIG. 4A is a side view of an illustrative embodiment of a compressor insert of a fluid compression system in accordance with the present disclosure.
Figure 4B:
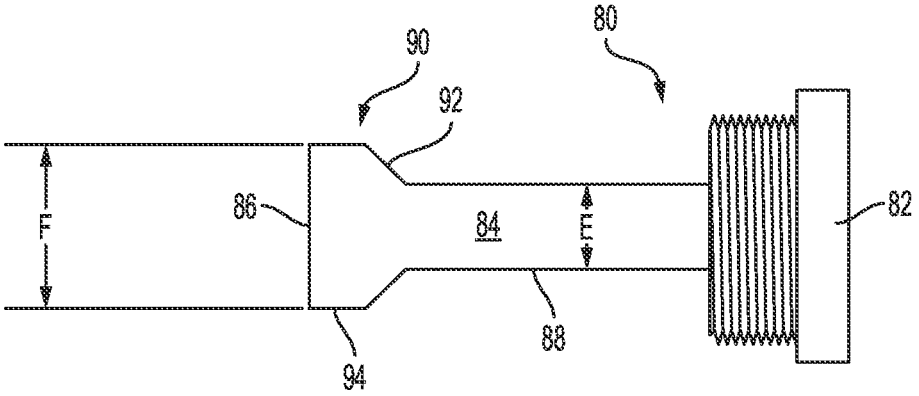
FIG. 4B is a side view of an illustrative embodiment of a compressor insert of a fluid compression system in accordance with the present disclosure.
Figure 4C:
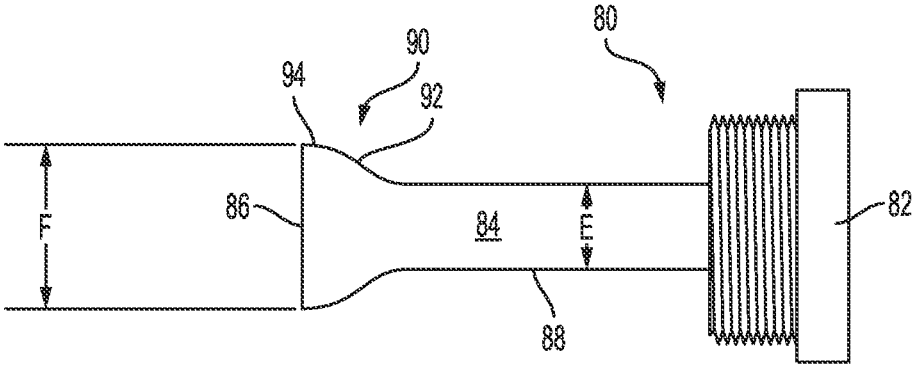
FIG. 4C is a side view of an illustrative embodiment of a compressor insert of a fluid compression system in accordance with the present disclosure.

With further reference to FIGS. 4A-4C, embodiments of the insert 80 may comprise the insert having the surface feature 90 positioned at or near the distal end 86. For example, the surface feature 90 may be a sloped region 92 that rises up from the diameter E of the body portion 84 and increases in diameter up to the distal end 86. Embodiments of the insert 80 may include the diameter E of the body portion 84 being about 4 mm and the sloped region 92 beginning to rise up off the exterior surface 88 of the body portion 84 at an angle of 30° until the largest diameter of 6.5 mm is reached at the distal end 86. Stated another way, the sloped region 92 may proportionately increase the diameter E of the body portion 84 by 50% at a 30° angle, thus creating a size or proportional relationship between the body portion 84 and the sloped region 92 independent of the initial size of the diameter E. Further, as depicted in FIG. 4B, the surface feature 90 may have a sloped region 92 that rises up off the diameter E of the body portion 84 to the second diameter F. The second diameter F may thereafter continue toward the distal end 86 for a predetermined length that is shorter than the length of the body portion 84 leading up to the sloped region 92. In other words, the sloped region 92 may define a second region 94, or plateau, between the sloped region 92 and the distal end 86, the second region 94 having a constant second diameter F for the predetermined length. The sloped region 92 may have a short axial length, such as, for example, an axial length as long as the sloped region 92 is high, or as much as the sloped region 92 rises up off of the body portion 84. Stated another way, the sloped region 92 may rise up off the diameter D of the body portion 84 at about a 45° angle. Further, as depicted in FIG. 4C, the surface feature 90 may have a sloped region 92 that rises up off the diameter E of the body portion 84 to the second diameter F. The second diameter F may thereafter continue toward the distal end 86 for a predetermined length that is shorter than the length of the body portion 84 leading up to the sloped region 92. In other words, the sloped region 92 may define a second region 94, or plateau between the sloped region 92 and the distal end 86, the second region 94 having a constant second diameter F for the predetermined length. The sloped region 92 may have a longer axial length, such as, for example, an axial length twice as long as the sloped region 92 is high, or twice as much as the sloped region 92 rises up off of the body portion 84. Stated another way, the sloped region 92 may rise up off the diameter D of the body portion 84 at about a 30° angle.

Initial testing without the insert 80 within the injection port 60 resulted in a flow of 252.22 ACFM at 46.77 kW package input power (29.44 in-Hg baro, 92.4° F. ambient, 100.0 PSIG discharge pressure). In subsequent testing, embodiments of the insert 80 were inserted within the injection port 60. This test provided 249.49 ACFM and 46.36 kW package input power (29.47 in-Hg baro, 92.5° F. ambient, 99.9 PSIG discharge pressure). This is an improvement in isentropic efficiency of approximately 1.2% and specific power of 1.7%. Additional tests show 1.9% improvement in specific power and 1.5% isentropic efficiency.

Including the disclosure of the structure and operation of the system 10 set forth above, embodiments of the system 10 may comprise a method of operating a compressor 20 and/or a method of injecting fluid into a compressor 20. The method may comprise providing a compressor in a fluid compression system. The method may comprise introducing a gas flow into the compression chamber of the compressor, compressing the gas flow within the compression chamber, and releasing the compressed gas flow from the compression chamber.

The method may further comprise introducing a fluid flow into an injection port that opens to the compression chamber of the compressor. The fluid flow may be introduced under injection pressure. As the fluid flows through the injection port, the method may further comprise increasing the velocity of the fluid flow through the injection port. The velocity may be increased by restricting the effective diameter of the injection port. The effective diameter of the injection port may be altered by placing an insert within the injection port, the insert having a diameter smaller than the diameter of the injection port. The method may further comprise further increasing the fluid flow as the fluid enters the compression chamber at the point the injection port opens into the compression chamber.

The velocity of the fluid as it exits the injection port may be increased by further reducing the effective diameter of the injection port. To further reduce the effective diameter, the diameter of the insert may be further increased toward the terminal, or distal, end of the insert. Further increasing the diameter of the insert may comprise forming a sloped region that increases in diameter over a predetermined length of the insert. With the sloped region configured near the distal end of the insert, the insert and the injection port may form an annular opening in the interior wall of the compression chamber wherein the fluid enters into the compression chamber.

The annular opening between the injection port and the inset may allow the method to further comprise shaping the fluid flow entering the compression chamber at the injection port. Due to the shape of the sloped region, the shape of the fluid flow may further comprise conical, annular, and/or ring-like shapes. These patterns may foster spraying of the fluid into the compression chamber and atomizing the fluid as it comes into contact with the compressed gas flowing through the compression chamber.

The method may further comprise releasably coupling the insert to the injection port or to the compressor wall. The method may further comprise removing the insert and replacing the insert with another insert or with an insert of different size and shape. The method may comprise inserting the insert within preexisting cross-drills of the compressor.

The materials of construction of the system 10 and its various component parts, including embodiments of the insert 80, may be formed of any of many different types of materials or combinations thereof that can readily be formed into shaped objects provided that the components selected are consistent with the intended operation of power tools and security lock-out devices of the type disclosed herein. For example, and not limited thereto, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining the above-described system 10 and its various component parts, including embodiments of the insert 80, may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, 3-D printing, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein.

What is claimed is:

1. A compressor comprising:

a compressor wall having an interior surface defining a compression chamber;

a rotor positioned within the compression chamber and in operative communication with the interior surface;

an injection port in the compressor wall, the injection port being in fluidic communication with the compression chamber; and an insert in operative communication with the injection port, wherein the insert and the injection port define therebetween an annular gap, and wherein a fluid entering the compression chamber through the injection port is influenced by the annular gap.

2. The compressor of claim 1, wherein the insert is positioned within the injection port, the injection port being a cylindrical bore having a first diameter and the insert being a cylindrical member having a second diameter smaller than the first diameter.

3. The compressor of claim 1, wherein the insert further comprises a surface feature at a distal end thereof.

4. The compressor of claim 3, wherein the surface feature is an annular slope that increases in diameter to the distal end.

5. The compressor of claim 4, wherein the slope increases the diameter of the insert by about 50 percent at about a 30 degree incline.

6. A compressor comprising:

a compressor wall having an interior surface defining a compression chamber;

a rotor positioned within the compression chamber and in operative communication with the interior surface;

an injection port in the compressor wall, the injection port being in fluidic communication with the compression chamber; and an insert in operative communication with the injection port, wherein the insert and the injection port define therebetween a gap, and wherein the insert further comprises an elongate body having a distal end, wherein the elongate body is positioned within the injection port and the distal end is exposed to the compression chamber.

7. The compressor of claim 6, wherein the distal end terminates at the interior surface.

8. The compressor of claim 7, wherein the distal end has a curvature to match a curvature of the interior surface.

9. A compressor comprising:

a compressor wall having an interior surface defining a compression chamber;

a rotor positioned within the compression chamber and in operative communication with the interior surface;

an injection port in the compressor wall, the injection port being in fluidic communication with the compression chamber; and an insert in operative communication with the injection port, wherein the insert and the injection port define therebetween a gap, and wherein the insert further comprises a first region and a second region, the second region being proximate a distal end of the insert and having a diameter larger than a diameter of the first region.

10. The compressor of claim 9, wherein the first and second regions are connected by a sloped surface.

11. The compressor of claim 10, wherein an axial length of the second region is substantially smaller than an axial length of the first region.

* * * * *